US005464482A

United States Patent [19]

Michael et al.

[11] Patent Number: 5,464,482

[45] Date of Patent: Nov. 7, 1995

[54] WASHARM ASSEMBLY FOR DISHWASHER

[75] Inventors: Daryl A. Michael, Stevensville, Mich.; Rodney M. Welch, Newton, Iowa

[73] Assignee: Maytag Corporation, Newton, Iowa

[21] Appl. No.: 335,457

[22] Filed: Nov. 7, 1994

[51] Int. Cl.[6] ..... A47L 15/22

[52] U.S. Cl. ..... 134/25.2; 134/172

[58] Field of Search ..... 134/22.18, 24, 134/25.2, 167 R, 168 R, 172, 176, 179, 180, 181; 239/227, 243, 244, 251, 261

[56] References Cited

U.S. PATENT DOCUMENTS 1,345,519 7/1920 Vaudreuil ..... 134/179 X 1,408,077 2/1922 Clinton ..... 239/227

2,631,059 3/1953 Karlstrom ..... 239/227

FOREIGN PATENT DOCUMENTS 1286820 8/1972 United Kingdom ..... 134/179

*Primary Examiner*—Philip R. Coe

*Attorney, Agent, or Firm*—Zarley, McKee, Thomte, Voorhees, & Sease

[57] ABSTRACT

An improved wash arm construction includes a primary wash arm having at least one secondary wash arm rotatably mounted to one of its ends. During the rotation of the primary wash arm within a substantially square chamber, the secondary wash arm is rotated so as to extend into the corners of the chamber during the rotation of the primary wash arm so as to create a generally square spray pattern.

14 Claims, 5 Drawing Sheets

WASHARM ASSEMBLY FOR DISHWASHER

BACKGROUND OF THE INVENTION

The present invention relates to a washarm assembly for dishwashers.

Current dishwashers use washarm designs which travel in circular paths and create a circular pattern of spraying within a square washing chamber filled with square racks full dishes.

Therefore a primary object of the present invention is the provision of an improved washarm assembly for dishwashers.

A further object of the present invention is the provision of an improved washarm assembly for dishwashers which provides a spray pattern extending into the corners of a square dish washing chamber containing square racks for holding dishes.

A further object of the present invention is the provision of an improved washarm assembly containing one or more rotating spray arms which are synchronized so as to permit extension of one of the rotating spray arms into the corners of the dishwasher during the spraying operation.

A further object of the present invention is the provision of an improved washarm assembly which is economical manufacture, durable in use, and efficient in operation.

SUMMARY OF THE INVENTION

The foregoing objects may be achieved by an improved washarm assembly which includes an upstanding support mounted within the washing chamber. An elongated first spray arm includes first and second opposite ends, a first fluid chamber contained within the first spray arm and a plurality of spray holes providing fluid communication between the first fluid chamber and the exterior of the spray arm. An elongated second spray arm having first and second opposite ends contains a fluid chamber and a plurality of spray holes providing fluid communication between the second fluid chamber and the exterior of the second spray arm. A first pivot mount pivotally mounts the first spray arm to the upstanding support for pivotal movement about a first axis within the washing chamber whereby the first spray arm will rotate in a first circular path about the first rotational axis. A second pivot mount pivotally mounts the second spray arm to the first spray to arm for pivotal movement about a second axis located adjacent an end of the first spray arm whereby the second spray arm will rotate in a second circular path about the second axis and at least the first end of the second spray arm will protrude radially outwardly beyond the end of the first spray arm during a portion of each revolution of the second spray arm about its second axis. A drive mechanism interconnects the upstanding support and the second spray arm for causing the first spray arm to rotate at a first rotational velocity and the second spray arm to rotate at a second rotational velocity greater than the first rotational velocity whereby the first and second spray arms rotating together will travel in a combined path in the form of a polygon.

The drive mechanism may be comprised of belts or chains trained around sprockets or may be comprised of interlocking gears on each of the rotating members.

DETAILED DESCRIPTION OF THE PREFERRED EMBODIMENT

Figure 1:
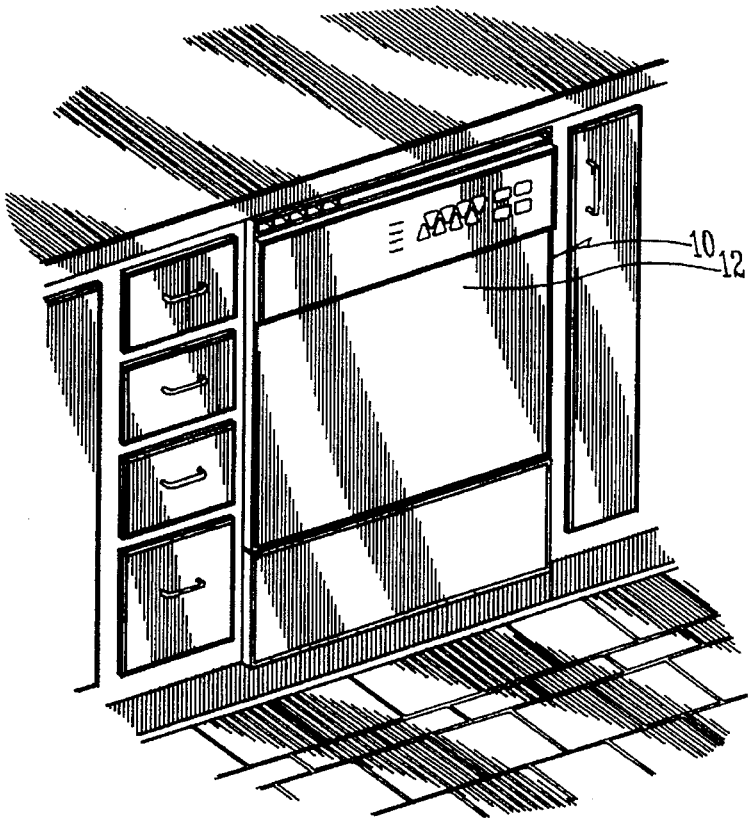
FIG. 1 is a perspective view of a dishwasher utilizing the wash arm construction of the present invention.
Figure 2:
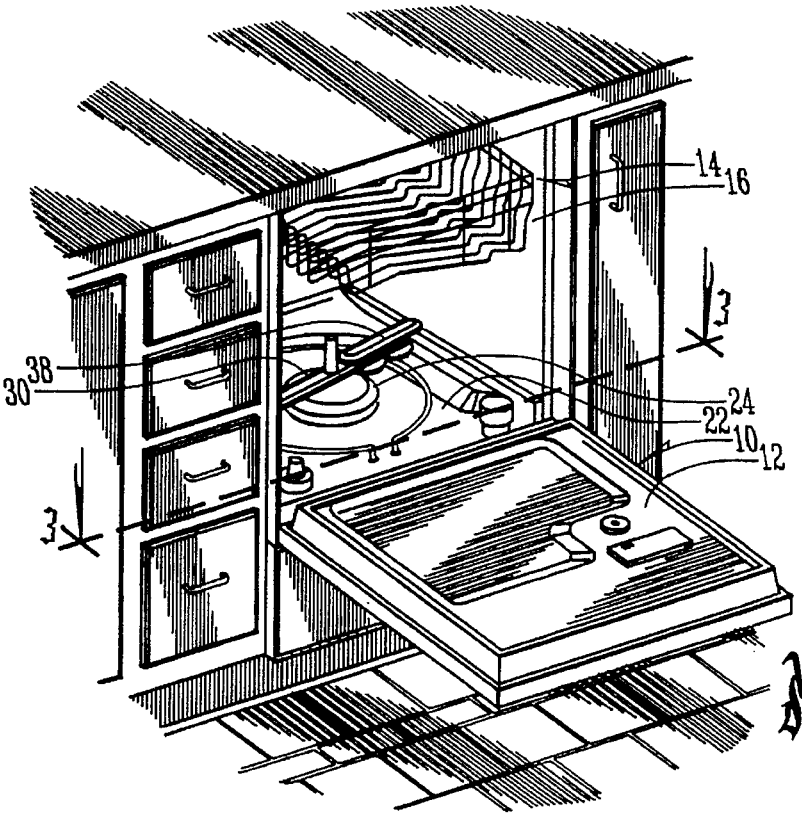
FIG. 2 is a view similar to FIG. 1 showing the front door of the dishwasher in its open position.

Referring to the drawings the numeral 10 generally refers to a dishwasher having an access door 12 providing access into a washing chamber 14 having side walls 16, 18, a rear wall 20, and a bottom wall 22.

Figure 3:
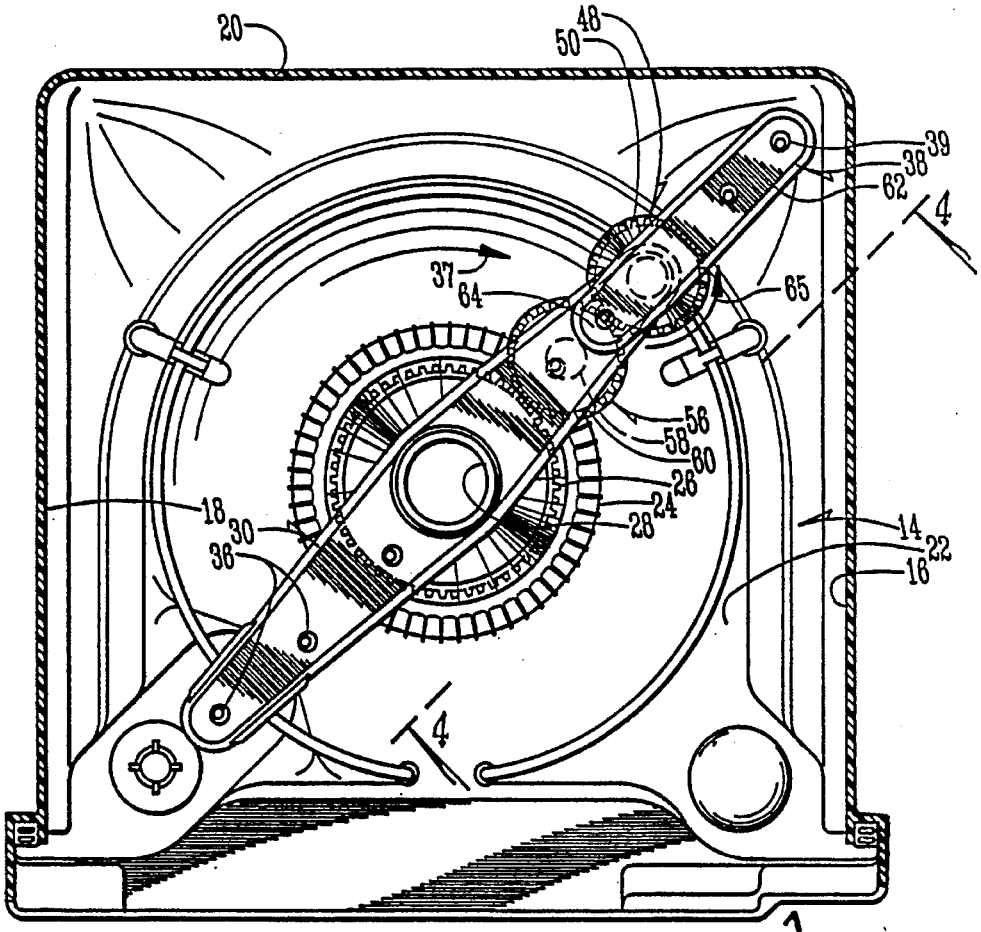
FIG. 3 is a sectional view taken generally along line 3—3 of FIG. 2.
Figure 4A:
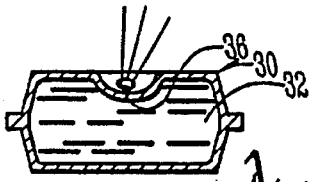
FIG. 4A is a sectional view taken generally along line *4a—4a* of FIG. 4.
Figure 4:
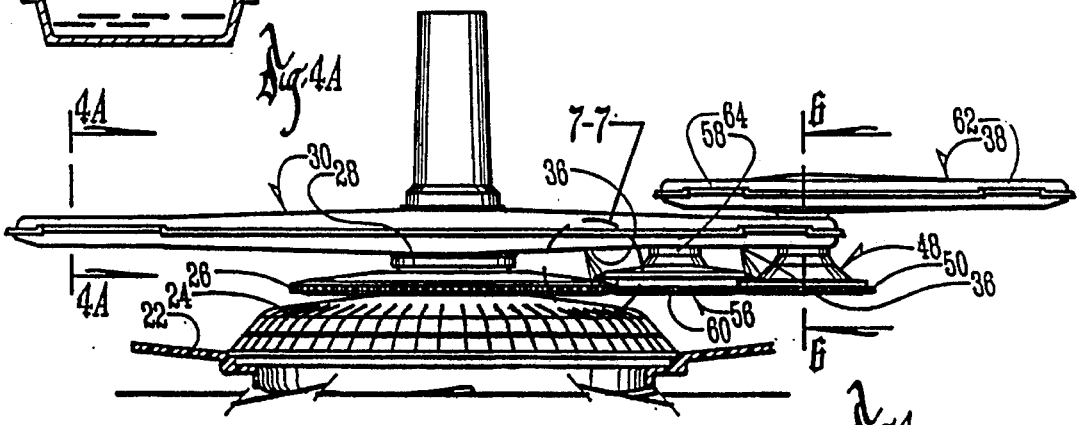
FIG. 4 is a sectional view taken generally along line 4—4 of FIG. 3.
Figure 5:
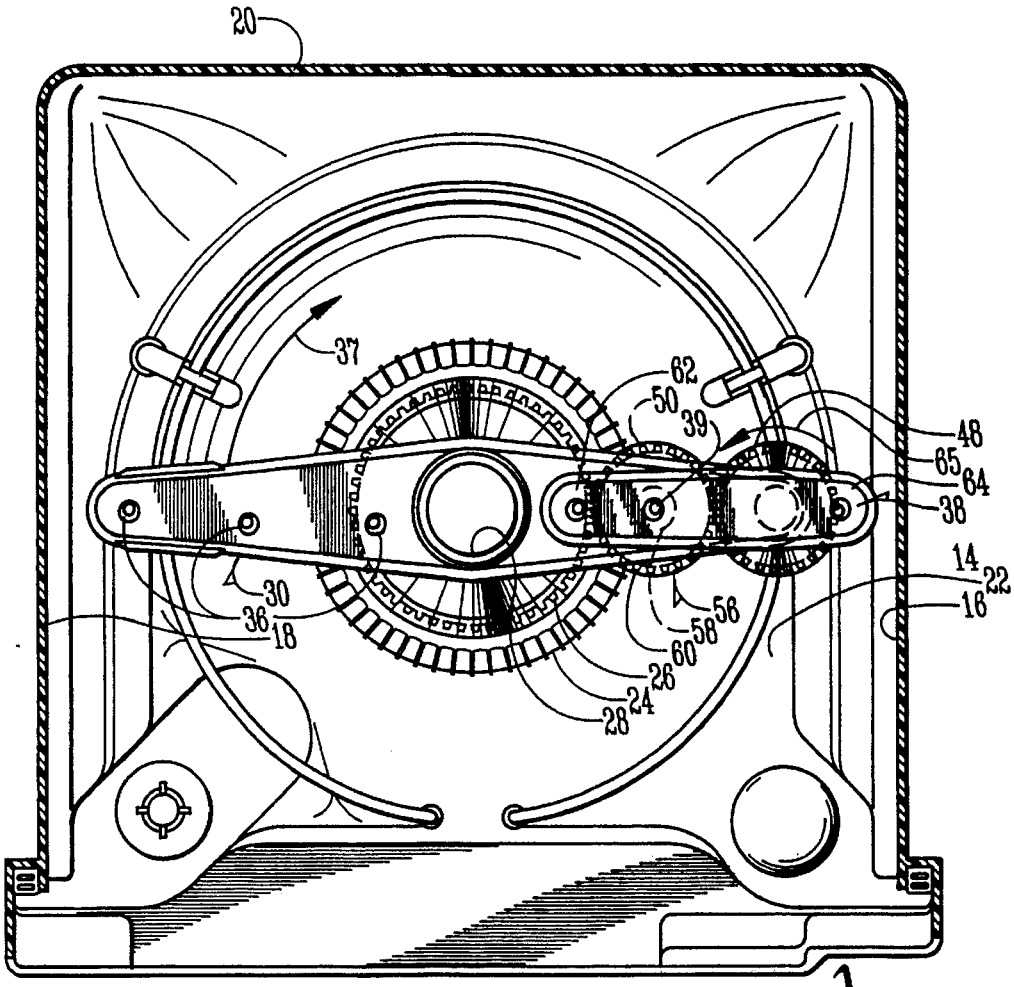
FIG. 5 is a view similar to FIG. 3, but showing the wash arms in a different position.

A pump housing 24 is mounted within the bottom wall 22 in conventional fashion, and includes on its outer surface a circular primary gear 26 which is fixed to the pump housing 24. Extending upwardly from gear 26 is a pivot mount 28 on which is pivotally mounted a primary wash arm 30 having a wash arm chamber 32 therein. Washing fluid is provided to the wash arm chamber 32 through the pivot mount of the pump housing 24 in conventional fashion and therefore the details of this fluid communication are not shown. Wash arm 30 includes a plurality of spray holes 36 through washing fluid is sprayed. Spray holes 36 can be angled in such a manner that the spraying of fluid outwardly from the spray holes 36 imparts a rotational movement to the wash arm 30 in the direction designated by arrow 37 in FIG. 3.

Figure 6:
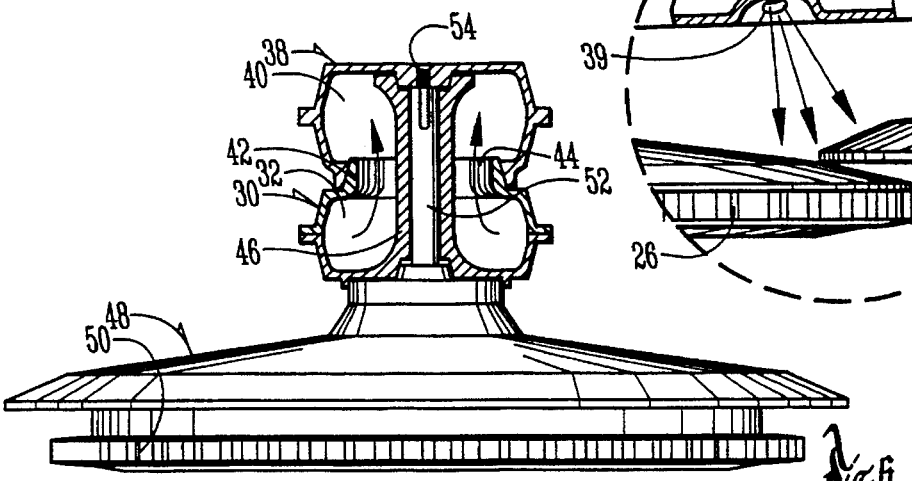
FIG. 6 is a sectional view taken generally along line 6—6 of FIG. 4.
Figure 7:
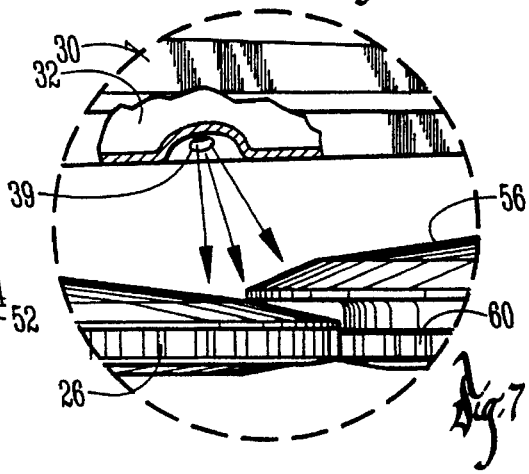
FIG. 7 is an enlarged detailed view taken generally along lines 7—7 of FIG. 4.

Pivotally mounted to one end of the primary wash arm 30 is a secondary wash arm 38 having a wash arm chamber 40 (FIG. 6) therein. The wash arm chamber 40 is in communication with the wash arm chamber 32 of primary wash arm 30 by means of an opening 44 in a connecting boss 42. The secondary wash arm 38 pivots on the connecting boss 42, and the opening 44 permits pressurized washing fluid to enter the wash arm chamber 40 of secondary spray arm 38. Secondary spray arm 38 is provided with spray openings 39.

Wash arm 30 is provided with an upstanding pivot post 46 (FIG. 6) which extends upwardly through the opening 44 and which surrounds a rotatable shaft 52. Shaft 52 is integrally connected with a secondary gear 48 having a circular array of teeth 50. A screw 54 extends downwardly through the top of secondary wash arm 38 into the shaft 52 so as to secure the secondary wash arm 38 to the secondary gear 48 for rotation in unison therewith.

Extending downwardly from primary wash arm 30 is an idler gear 56 which is rotatably mounted to primary wash arm 30 by means of an idler gear post 58. Idler gear 56 includes idler gear teeth 60 which intermesh with the gear teeth 50 of secondary gear 48 and with the teeth of primary gear 26 which is fixed relative to the pump housing 24.

Figure 8:
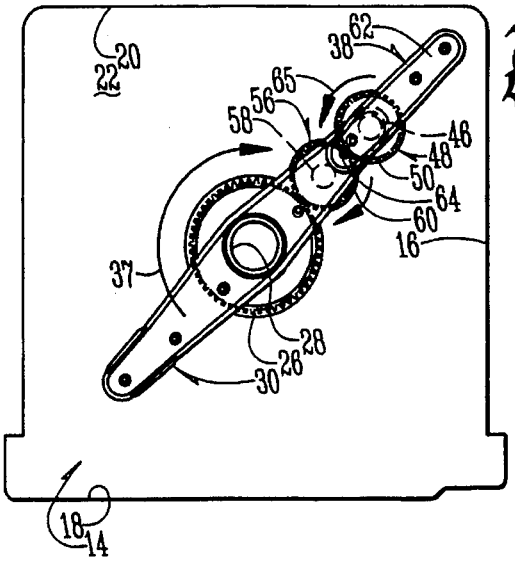
FIGS. 8–10 are schematic views showing the various positions of the wash arm construction illustrated in FIGS. 1–7.
Figure 9:
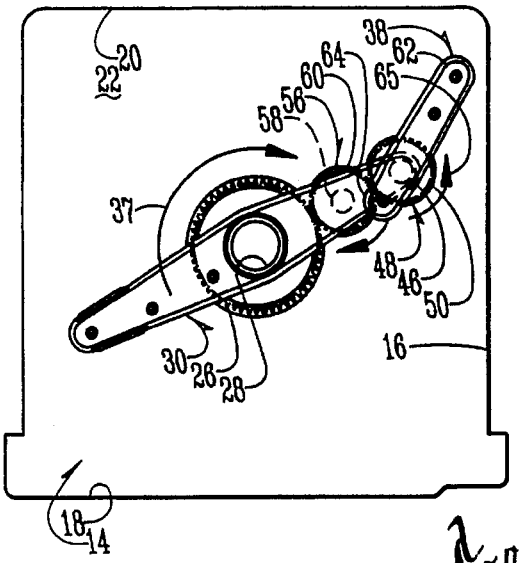
Figure 10:
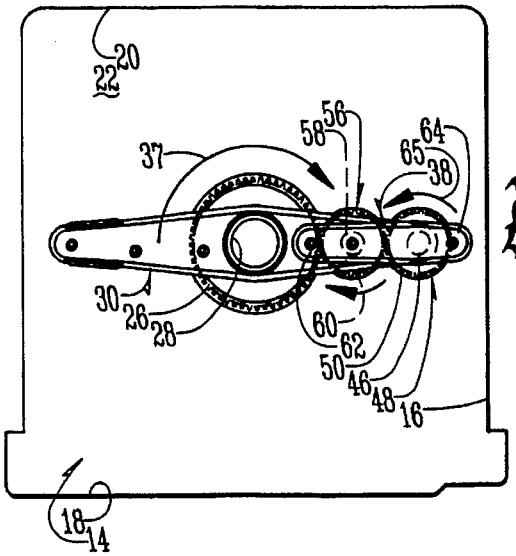

It should be noted that the secondary wash arm 38 is pivotally mounted about an axis which is adjacent one end of secondary wash arm 38, thus causing a long end 62 and a short end 64. Referring to FIGS. 8, 9, and 10, the relative movements of the wash arms 30, 38 are shown. When the fluid is introduced under pressure to the interior of primary wash arm 30, the spraying of the fluid from some of the spray openings 36 imparts a circular rotation of the wash arm 30 in the direction shown by arrow 37. Alternately, the secondary wash arm 38 can include drive holes and can drive the primary wash arm 30. This rotational movement, by virtue of the intermeshing primary gear 26, idler gear 56, and the secondary gear 48, imparts a rotational movement to the secondary wash arm 38 in the direction shown by arrow 65. Furthermore, the gear ratios of gears 26, 56, and 48 are such that secondary gear 48 rotates four times for every single rotation of primary wash arm 30. This causes the long end 62 of the secondary wash arm 38 to extend outwardly into each of the four corners of the washing chamber 14 during each revolution of the primary wash arm 30. Thus the long end 62 of secondary wash arm 38 moves from its position extending into the corner of the washing chamber 14 as shown in FIG. 8 to an intermediate position wherein it is rotated away from its fully extended position as shown in FIG. 9 to the position shown in FIG. 10 wherein the long end 62 is pointing towards the rotational axis of the primary wash arm 30 and the short arm 64 is adjacent the side walls of the washing chamber 14.

This process repeats for each of the four corners of the washing chamber 14. The present invention could also be used in a washing chamber having any of a variety of polygonal shapes, with the ratio of the gears being such that for a polygon having n corners the secondary wash arm 38 will rotate n revolutions for each one revolution of the primary wash arm 30.

Figure 11:
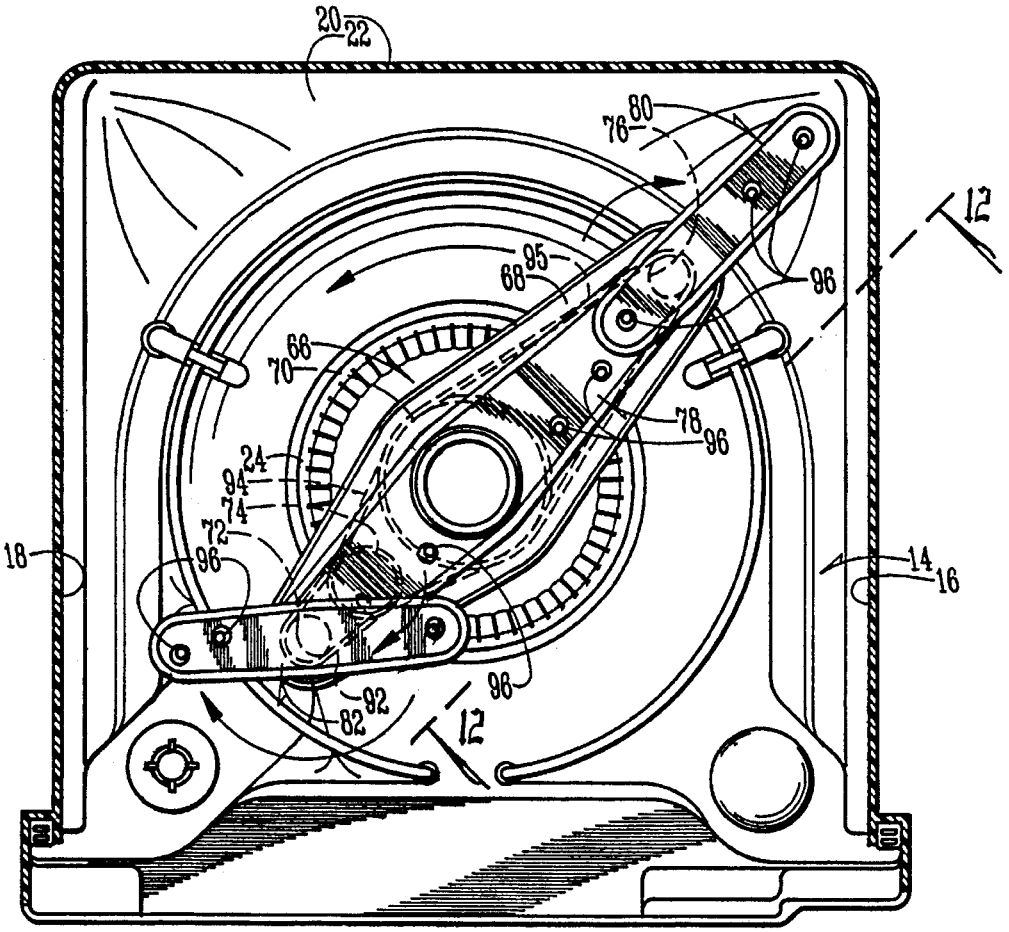
FIG. 11 is a view similar to FIG. 3, but showing a modified form of the wash arm construction.
Figure 13:
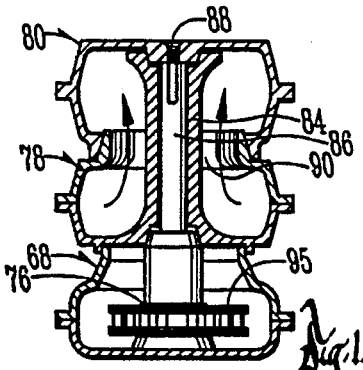
FIG. 13 is a sectional view taken generally along line 13—13 of FIG. 12.
Figure 12:
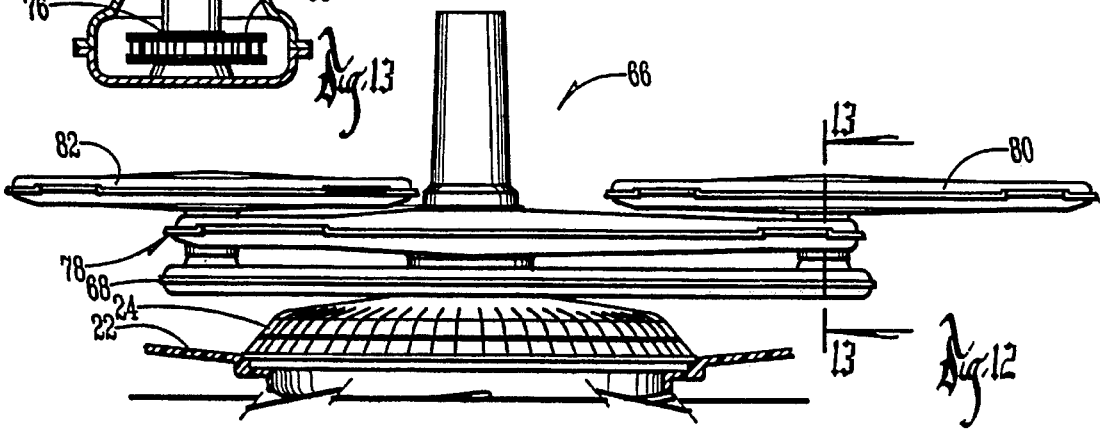
FIG. 12 is a sectional view taken generally along line 12—12 of FIG. 11.

Referring to FIGS. 11–13 a modified form of the invention is shown and is designated by the numeral 66. The device shown in FIG. 11 uses a different mechanism for driving the wash arm assembly. A sprocket housing 68 is pivotally mounted to the pump housing 24 for rotation therewith. Two vertically stacked pump sprockets 70 are fixed to the pump housing and are contained within the sprocket housing 68. Rotatably mounted within the sprocket housing 68 are a small drive arm sprocket 72 and two vertically stacked large drive arm sprockets 74. At the opposite end of sprocket end 68 is rotatably mounted a secondary arm sprocket 76.

Rotatably mounted to the pump housing 24 above the sprocket housing 68 is a primary wash arm 78. It should be noted that the wash arm 78 is pivotally mounted off center from its longitudinal midpoint. Rotatably mounted to one end of the primary wash arm 78 is a secondary wash arm 80 similar in construction to the secondary wash arm 38 shown in FIGS. 1–10. At the other end of primary wash arm 78 is rotatably mounted a drive arm 82. FIG. 13 shows the pivotal connection of secondary wash arm 80 to the primary wash arm 78, and a similar construction is provided for rotatably mounting the drive wash arm 82 to the primary wash arm 78 and therefore is not shown in the drawings. A pivot post 84 extends upwardly from primary wash arm 78 and a sprocket shaft 86 is rotatably mounted therein and connected at its lower end to the sprocket 76. A screw 88 attaches the secondary wash arm 80 to the sprocket shaft 86. Fluid is permitted to communicate from the interior of the primary wash arm 78 to the interior of the secondary wash arm 80 by means of an opening 90.

A drive belt or chain 92 is trained around drive sprocket 72 and one of the vertically stacked drive sprockets 74. A second drive belt or chain 94 is trained around the other drive sprocket 74 and around one of the two sprockets 70 which are fixed to the pump housing 24. A third drive belt or chain 95 is trained around the other of the pair of sprockets 70 and around the secondary arm sprocket 76.

Figure 14:
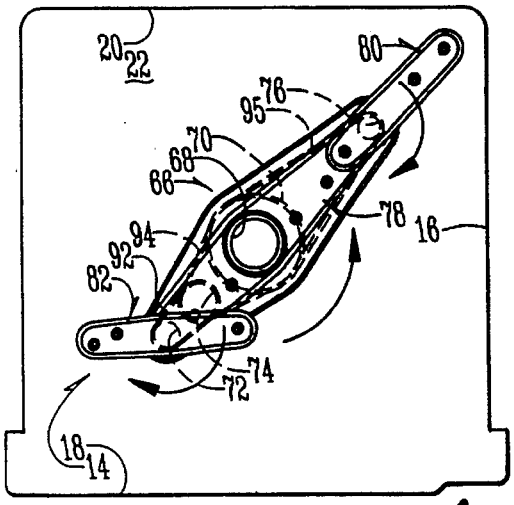
FIGS. 14 and 15 are schematic views showing the various positions of the wash arm assembly shown in FIGS. 10–13.
Figure 15:
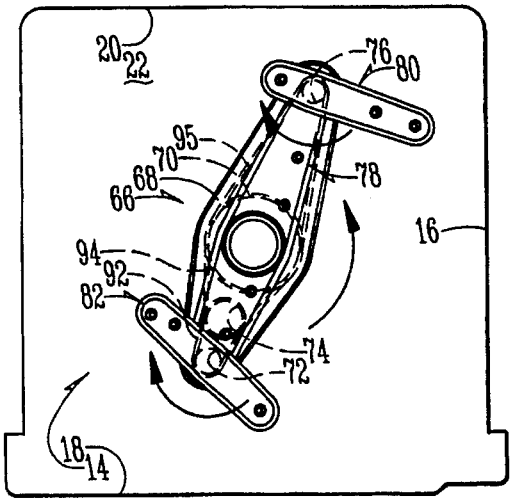

When pressurized fluid is introduced into primary wash arm 78, that pressurized fluid is also introduced into the secondary wash arm 80 and the drive wash arm 82. As the pressurized fluid is sprayed outwardly through the spray holes 96 of drive wash arm 82, it imparts a rotational movement to drive wash arm 82. Similar spray holes 96 are contained in primary wash arm 78 and secondary wash arm 80, and the spray holes also can be angled to facilitate the rotation of the primary and secondary wash arms 78 and 80. However, the primary driving force for the three wash arms is provided by wash arm 82 which rotates at much higher RPMs than the primary wash arm 78 or the secondary wash arm 80. This is achieved by the relative sizes of the two sprockets 72 and 74. Thus the drive wash arm 82 causes rotation of the sprockets 72 and 74 which in turn impart a rotational movement to the primary wash arm 78. As the primary wash arm 78 rotates, the belt 95 causes rotation of the secondary wash arm 80. It should be noted that the primary wash arm 78 is mounted off center so that the drive wash arm 82, when extending to its extreme outer most position, balances the spray pattern created by the opposite of the primary wash arm 78. As seen in FIGS. 14 and 15 the secondary wash arm 80 protrudes into the corners of the square washing chamber and rotates so as to present its short end toward the walls of the washing chamber during the time that the primary wash arm is moving from one corner to another.

Thus the devices shown in FIGS. 1–15 make possible the provision of a substantially square washing pattern from the various rotations of the wash arms in the assembly.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A wash arm device for a washing appliance comprising:

an upstanding support;

an elongated first spray arm having first and second opposite ends;

an elongated second spray arm having first and second opposite ends;

a first pivot mount pivotally mounting said first spray arm to said upstanding support for pivotal movement about a first axis whereby said first spray arm will rotate in a first circular path about said first axis;

a second pivot mount pivotally mounting said second spray arm to said first spray arm for pivotal movement about a second axis located adjacent an end of said first spray arm, whereby said second spray arm will rotate in a second circular path about said second axis and at least said first end of said second spray arm will protrude radially outwardly beyond the end of said first spray arm during a portion of each revolution of said second spray arm about said second axis;

a drive mechanism interconnecting said upstanding support and said second spray arm for causing said first spray arm to rotate at a first rotational velocity and said second spray arm to rotate at a second rotational velocity which is greater than said first rotational velocity whereby said first and second spray arms rotating together will travel in a combined path in the form of a polygon.

2. A wash arm device according to claim 1 wherein said second axis is adjacent said second end of said second spray arm.

3. A wash arm device according to claim 1 wherein said drive mechanism causes said second spray arm to rotate in a direction opposite from the rotational direction of said first spray arm.

4. A wash arm device according to claim 1 wherein said drive mechanism causes said first and second spray arms to rotate at relative rotational velocities which cause said polygon to be a rectangle.

5. A wash arm device for use in an appliance cabinet having side walls joined together to form n corners therebetween, said side walls surrounding and forming an appliance chamber which is in the shape of a polygon having n sides and n corners comprising:

an upstanding support within said appliance chamber;

a first spray arm rotatably mounted to said upstanding support for rotation about a first axis, said first spray arm having first and second opposite ends;

a second spray arm rotatably mounted to said first spray arm for rotation about a second axis, said second spray arm having first and second opposite ends, at least said first end of said second spray arm protruding beyond one end of said first spray arm during a portion of its rotational path around said second axis;

drive mechanism interconnecting said upstanding support and said second spray arm for causing said second spray arm to rotate in a direction opposite from, and at a predetermined velocity ratio relative to said first spray arm in response to rotation of said first spray arm about said first axis, said predetermined velocity ratio being such that said first end of said second spray arm rotates to extend into each of said n corners and rotates to a position clearing each of said n walls during rotation of said first spray arm about said first axis.

6. A wash arm device according to claim 5 wherein n is 4.

7. A wash arm device according to claim 5 wherein each of said first and second spray arms include a spray chamber therein and spray holes communicating between said spray chamber and the exterior of said first and second spray arms respectively, fluid delivery means for delivering pressurized fluid to said spray chambers of both of said first and second spray arms respectively whereby said fluid is sprayed outwardly through said spray holes of said first and second spray arms.

8. A wash arm device according to claim 1 or 5 wherein said drive mechanism comprises a first gear on said upstanding support and a second gear associated with said second spray arm.

9. A wash arm device according to claim 8 and further comprising gear means interconnecting said first and second gears for transferring relative rotational movement therebetween.

10. A wash arm device according to claim 9 wherein said first gear is fixed relative to said upstanding support and said second gear is fixed relative to said second spray arm.

11. A wash arm device according to claim 8 wherein a flexible member is trained around said first and second gears for transferring relative rotational movement therebetween.

12. A wash arm device according to claim 1 or 5 and further comprising an elongated third spray arm having first and second opposite ends, a fluid chamber therein, and a plurality of spray holes providing fluid communication from said fluid chamber to the exterior of said third spray arm; a third pivot mount pivotally mounting said third spray arm to said first spray arm for pivotal movement about a third axis located adjacent said second end of said first spray arm.

13. A wash arm according to claim 12 wherein said drive mechanism interconnects said upstanding support and said third spray arm for causing said third spray arm and said first spray arm to rotate in a predetermined rotational velocity ratio with respect to one another, said velocity ratio causing said third spray arm to rotate at a substantially faster rotational velocity than the rotational velocity of said first spray arm.

14. A method for spraying fluid in an appliance chamber having n side walls forming n corners therebetween, said method comprising:

rotating a first spray arm about a first vertical axis within said appliance chamber.

spraying fluid outwardly from a first spray chamber in said first spray arm through a plurality of spray holes in said first spray arm so as to create a first circular spray pattern around said first vertical axis;

spraying fluid outwardly from a second spray chamber within a second spray arm through a plurality of spray holes in said second spray arm, said second spray arm being rotatably connected to said first spray arm for rotation about a second vertical axis;

rotating said second spray arm about said second vertical axis during rotation of said first spray arm about said first vertical axis, so that at least a portion of said second spray arm extends beyond the end of said first spray arm and into each of said n corners of said appliance during rotation of said first spray arm about said first vertical axis.

* * * * *